US006699016B1

(12) United States Patent
Dean

(10) Patent No.: US 6,699,016 B1
(45) Date of Patent: Mar. 2, 2004

(54) BOAT PROPELLER

(76) Inventor: Peter Dean, 422 Mount Vernon Rd., Monroe, GA (US) 30655

( * ) Notice: Subject to any disclaimer, the term of this patent is extended or adjusted under 35 U.S.C. 154(b) by 3 days.

(21) Appl. No.: 10/172,797

(22) Filed: Jun. 12, 2002

Related U.S. Application Data

(60) Provisional application No. 60/297,477, filed on Jun. 12, 2001.

(51) Int. Cl.[7] ..... B63H 1/26

(52) U.S. Cl. ..... 416/235; 416/236 R; 416/223 R

(58) Field of Search ..... 416/228, 236 R, 416/235, 243, 93 A

(56) References Cited

U.S. PATENT DOCUMENTS 2,396,811 A * 3/1946 Bathras ..... 416/235
2,978,040 A * 4/1961 Wirkkala ..... 416/228
4,047,835 A 9/1977 Hornung
4,080,099 A 3/1978 Snyder
5,104,292 A 4/1992 Koepsel et al.
5,236,310 A 8/1993 Koepsel et al.
5,791,874 A 8/1998 Lang
6,267,634 B1 7/2001 Ewald et al.
6,352,408 B1 3/2002 Kilian
6,390,776 B1 5/2002 Gruenwald

* cited by examiner

*Primary Examiner*—Ninh H. Nguyen

(57) ABSTRACT

An improved watercraft propeller is provided with a hub having a plurality of outwardly extending blades, and at least one reverse thrust member connected to a selected blade of the propeller. The blade to which the reverse thrust member is connected can provide a blade pitch that is constant, variable, progressive, or regressive. The reverse thrust member is formed integrally with or connected to a leading edge of the selected blade. The reverse thrust member effectively increases the pitch of the propeller when operated to propel a watercraft in a reverse direction, thereby improving the performance and efficiency of the propeller.

29 Claims, 3 Drawing Sheets

BOAT PROPELLER

CROSS-REFERENCE TO RELATED PATENT APPLICATION

This application claims priority to, and the benefit of the filing date of provisional U.S. patent application Ser. No. 60/297,477 entitled "Boat Propeller Blade," filed on Jun. 12, 2001, in the United States Patent and Trademark Office, the provisions of which are incorporated herein by this reference.

FIELD OF THE INVENTION

The invention relates in general to boat propellers. More particularly, the present invention relates to an improved boat propeller blade edge design.

BACKGROUND OF THE INVENTION

Recreational boating is an activity enjoyed by a great many people, employing a wide variety of boat types. Among the many types of recreational boats that exist are speedboats, ski boats, fishing boats, and houseboats. In fact, houseboats have become an increasingly popular form of boating as a weekend or vacation home, and for many have risen to the status of a permanent residence. For example, there are over 100,000 houseboats in the United States alone.

The common feature among these many types of watercraft, however, is that each is propelled using any one of the known types of boat drives. The known types of recreational boat drives fall mainly into two categories, jet drives and propeller drives. As the name implies, a jet drive uses a water jet generated by a thruster or an impeller, whereas the propeller drive uses a propeller powered by a suitable drive motor, as known. Jet drives are used primarily in the personal watercraft industry, and the majority of recreational boats use a propeller drive. Houseboats generally use a propeller drive provided as a part of an inboard, outboard, or inboard/outboard motor and propeller drive assembly properly sized for the boat and its handling requirements.

The problem with handling a houseboat lies largely in its size and weight. A problem that has arisen with the increasing use of houseboats is that a houseboat is slow to respond to steering and power inputs or commands, especially so when making a reverse movement in that the houseboat may not respond as quickly as needed, and more so for the novice boater than for the accomplished boater. Accordingly, and using the known types of boat propeller designs, houseboats have great difficulty achieving enough reverse thrust to be able to dock the craft in an efficient, controllable manner. This problem is particularly apparent when docking at, and moving away from fuel docks for example, where slow, careful movement is required.

There has always been an acceptable level of forward thrust using propeller drive systems with boats, but the lack of adequate reverse thrust has generally resulted in poor controllability of the boat. Over the past twenty years, as the size of the typical houseboat has increased, for example, there is a need for more or greater reverse thrust to control the boat, or to stop it in an emergency. Previous solutions to this problem centered on increasing the propeller diameter, engine size, and/or drive size.

The use of larger propellers combined with larger powerplants has resulted in some improved reverse control of houseboats. However, in so doing, houseboats and other watercraft have become environmentally unfriendly by consuming relatively large amounts of fuel while simultaneously adding increased levels of pollutants to the surrounding air and water environment within which the boat is used. Also, and under certain conditions, the people on the watercraft itself may experience an increase in the amount of exhaust fumes coming into the cabin from the greatly increased engine power requirements, and revolutions, needed to reverse the boat while also pulling the boat back through its own exhaust gases.

What is needed, therefore, but unavailable in the art, is an improved boat propeller design. In particular a propeller blade edge construction or member is needed that will improve the reverse efficiency of the propeller blade, particularly for use with larger boats, for example a houseboat.

SUMMARY OF THE INVENTION

The present invention provides an improved boat propeller comprising a hub having a plurality of blades extending outwardly therefrom, and at least one reverse thrust member connected to at least one blade of the propeller. The blade to which the reverse thrust member is connected can comprise, in one embodiment, a constant blade pitch. In another embodiment, the blade comprises an increasing blade pitch. In yet another embodiment, the blade comprises a decreasing blade pitch. A proximal edge of the reverse thrust member is formed integrally with or affixed to a leading edge of the at least one propeller blade. The reverse thrust member effectively increases the pitch of the propeller when used to propel a watercraft in a reverse direction, thereby improving the performance and efficiency of the propeller.

The reverse thrust member may be formed as an integral part of the blade or may be attached thereto. In one embodiment the reverse thrust member comprises an arcuate hook-shape defined by a radius of curvature which may be constant or may vary along a portion of the length of the reverse thrust member. In other embodiments the reverse thrust member comprises "T" or "L" shapes in cross-section.

The propeller provided may allow houseboat operation using a single engine installation, or a smaller twin engine installation for use in powering the boat as reverse drive efficiency is greatly enhanced by the invention. The invention may also have the desirable effect of reducing the amount of engine fuel consumption and pollution, and may allow engine/boat manufacturers to efficiently use a 4-stroke engine rather than a 2-stroke engine to attain the desired performance in both the forward and rearward directions. This may reduce the environmental impact of these boats.

Moreover, as houseboats do not generally exceed a speed of approximately 10 knots due to the houseboat having a full displacement hull, and as the only reason these boats are otherwise provided with massive power, i.e., larger engines, is to enable the boat to match its powerplant with the larger propeller blade designs needed to assist the boat when moving in the reverse direction, an advantage of the propeller blade design of this invention is to more efficiently direct the engine horsepower to moving the boat in the reverse direction, and with a smaller powerplant than previously thought possible in the art.

The invention may thus provide an increase of reverse thrust in the range of from 50% to 100% over the conventional boat propellers available in the art, thus tending to minimize the above-described problems of the known propeller designs.

DETAILED DESCRIPTION OF THE INVENTION

The present invention is more particularly described in the following examples that are intended as illustrative only since numerous modifications and variations therein will be apparent to those skilled in the art. As used in the specification and in the claims, "a," "an," and "the" can each mean one or more, depending upon the context in which it is used. The invention is now described with reference to the Figures, in which like numbers indicate like parts throughout the several views.

Figure 1:
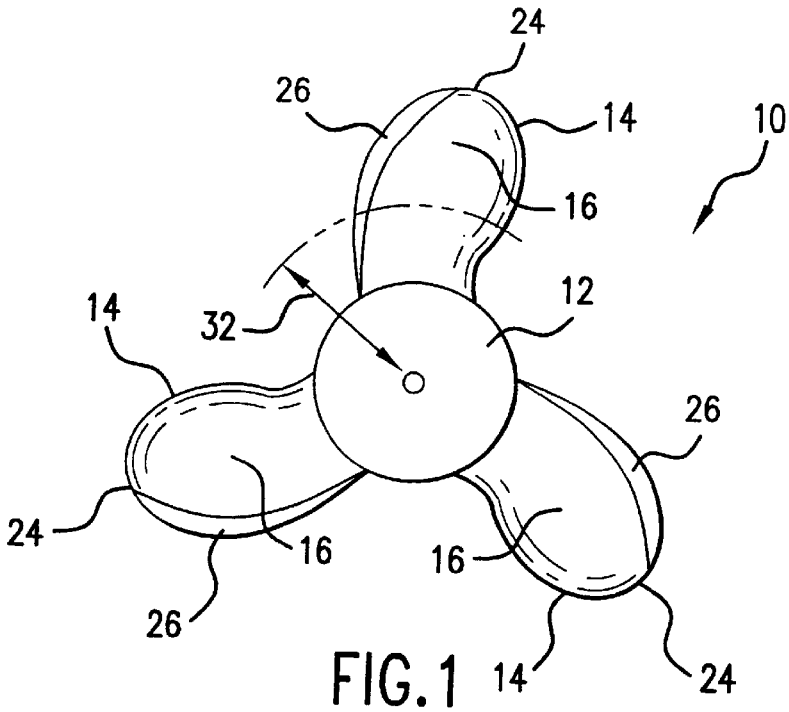
FIG. 1 is a top plan view of the forward face of a preferred embodiment of the boat propeller of the invention.

Referring now to FIG. 1, a watercraft propeller 10 provided with a central hub 12 having a plurality of radial blades 14 affixed thereto, spaced about and extending outwardly from the hub, is illustrated. The hub 12 is conventionally constructed to be received on or affixed to a suitable drive shaft such that the propeller 10 can be used to propel a watercraft (not illustrated) as known. The propeller 10 is illustrated in a fore view such that the blade backs 16, i e., the blade surfaces facing the forward direction of a watercraft, are shown. The propeller 10 is rotated by a suitable drive system in a counterclockwise direction looking at FIG. 1 when used to propel a watercraft in a forward direction. Conversely, when rotated in a clockwise direction looking at FIG. 1, the propeller 10 provides reverse thrust to a watercraft as the blade backs 16 define pressure surfaces when so rotated. An advantage of the propeller 10 over the prior art when used in propelling a watercraft in a reverse direction, therefore, is an efficient and effective reverse thrust effected by the inventive reverse thrust members 26.

Figure 2:
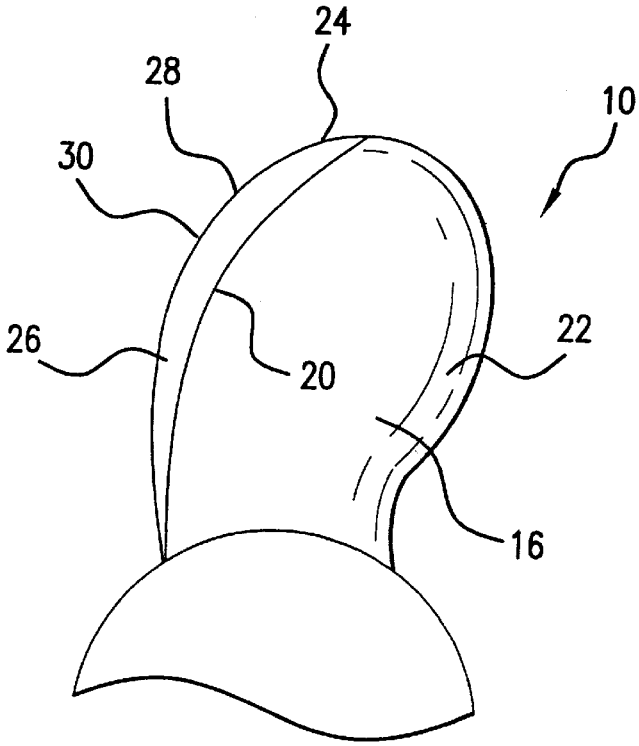
FIG. 2 is an enlarged, partial detail view of a portion of the propeller of FIG. 1.

As illustrated in FIG. 2, each propeller blade comprises a leading edge 20 and a spaced trailing edge 22, with the leading edge being that edge of the blade projecting in a "forward" direction of the hub and thus the watercraft. Each reverse thrust member 26 projects in a forward direction and away from the pressure surface defined by the blade back 16, and comprises a proximal edge 28 connected to the leading edge of the blade and a spaced distal edge 30. In the illustrated embodiment of FIGS. 1 and 2, the reverse thrust member 26 extends from the hub to a blade tip 24 defined at that point of the blade most distal from the hub. Though not illustrated, other embodiments of the propeller 10 can provide a reverse thrust member extending along any portion of the leading edge of the blade, as desired. For example, the reverse thrust member may extend from a point spaced from the hub along the leading edge to any point along the leading edge spaced from the blade tip, or adjacent the tip.

As known, the pitch of a propeller is defined as that distance through a non-turbulent medium which the propeller travels on one full rotation of the propeller, much like a screw is rotated to penetrate a solid. Pitch can be similarly defined for any portion of a propeller blade. Constant and progressive pitch blades are known and conventional. Further, as is known and conventional, a first portion of a blade surface at a first angle relative to a rotation axis of a propeller hub generally has a greater pitch than a second portion of a blade surface at a second angle relative to the rotation axis if the first angle is less than the second angle, provided neither of the first and second portions, respectively, are parallel or perpendicular to the rotation axis. The inventive reverse thrust member thus provides a pitch greater than that of the blade, whether that pitch be constant, increasing, or decreasing, when operated to propel the watercraft in a reverse direction. In FIG. 1, the reverse thrust member 26 thus provides a pitch at a given radius 32, measured from the center of the hub, that is greater than the pitch of the blade 14 at the given radius.

Figure 3:
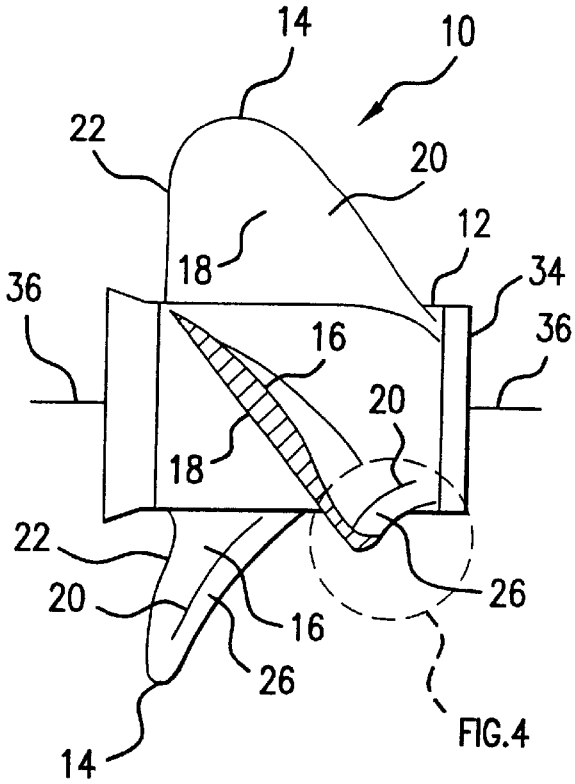
FIG. 3 is a side elevational view of a first embodiment of the propeller of the invention, having a constant pitch blade and a reverse thrust member on the leading edge of the blade.

In FIG. 3, a first embodiment of the propeller of the invention having a constant pitch blade 14 and a reverse thrust member 26 is shown in cross-sectional view, attached to the propeller 10 through the hub 12. The leading edges 20 of the respective blades 14 are proximal the forward end 34 of the hub and the trailing edges 22 are spaced therefrom. The blade backs 16 once again define pressure surfaces when the propeller is rotated to provide reverse thrust. The illustrated constant pitch propeller has a blade face 18 formed opposite the blade back 16 with a constant angular relation between the blade face and longitudinal axis 36 of rotation extending through the hub.

Figure 4:
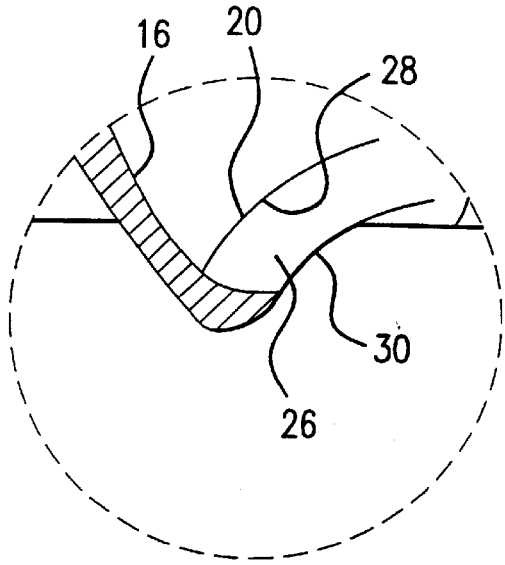
FIG. 4 is an enlarged detail view, taken along the broken line of FIG. 3, of a portion of the leading edge of the propeller blade.

FIG. 4 is a partial exploded view, taken along the broken line in FIG. 3, showing a forward portion of the blade and the reverse thrust member 26 in cross-sectional view at a given radius from the center of the hub. The reverse thrust member 26 projects in a forward direction and extends away from the pressure surface defined by the blade back 16. The reverse thrust member comprises a proximal edge 28 connected to the leading edge 20 of the blade and a spaced distal edge 30. As illustrated, the reverse thrust member 26 provides a pitch at the given radius that is greater than the pitch of the blade back 16.

Figure 5:
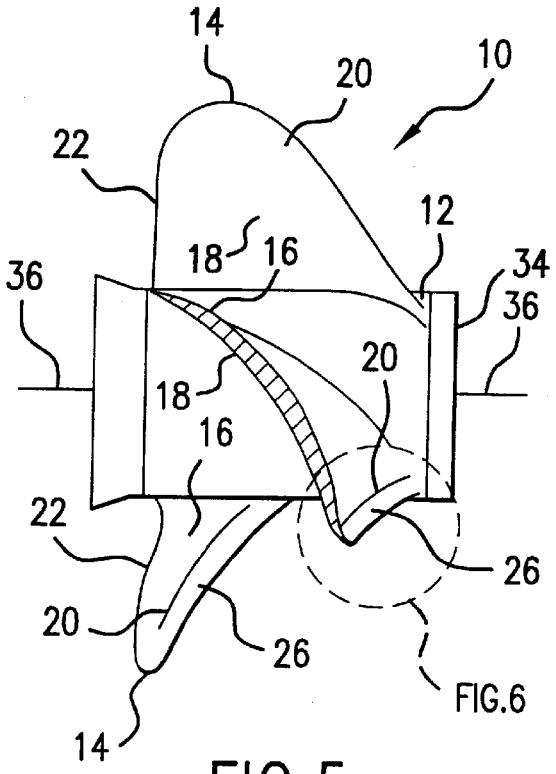
FIG. 5 is a side elevational view of a second embodiment of the propeller of the invention, having a progressive pitch blade and a reverse thrust member on the leading edge of the blade.

In FIG. 5, a second embodiment of the invention having an increasing progressive pitch blade 14 and a reverse thrust member 26 is shown in cross-sectional view, again attached to the propeller 10 by the hub 12. The respective leading edges 20 of the blades 14 are proximal the forward end 34 of the hub and the trailing edges 22 are spaced therefrom.

Each of the blade backs 16 defines a pressure surface when the propeller is rotated to provide reverse thrust. The illustrated increasing pitch propeller has a blade face 18 formed opposite the blade back 16 with a varying angular relation between the blade face and the axis of rotation 36. A trailing edge 22 of such a progressive pitch blade 14 provides a greater pitch than a leading edge 20.

Figure 6:
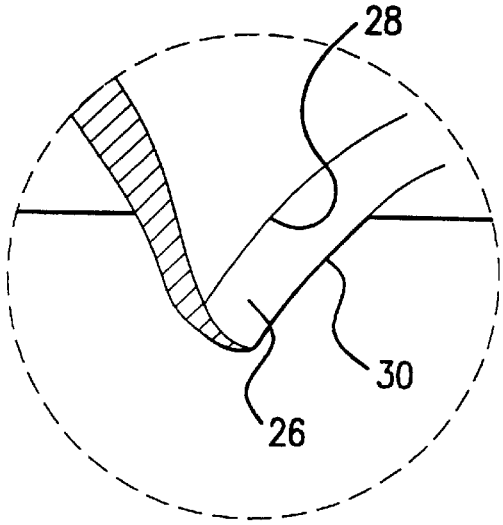
FIG. 6 is an enlarged detail view, taken along the broken line of FIG. 5, of a portion of the leading edge of the propeller blade.

FIG. 6 is a partial exploded view, taken along the broken line in FIG. 5, of the propeller showing the blade and reverse thrust member 26 in cross-sectional view. The illustrated reverse thrust member 26 comprises an arcuate shape or hook-shape in cross-section. Accordingly, the illustrated reverse thrust member tapers from the proximal edge 28 to the distal edge 30. The concavity of the forward face of the reverse thrust member is defined by a radius of curvature and provides a decreasing pitch extending from the distal edge to the proximal edge thereof. The radius of curvature defining the concavity or hook-shape may vary along the length of the reverse thrust member or may remain a constant, as desired. The radius of curvature may vary along at least a portion of increasing radii from a given radius, meaning the radius of curvature may increase along the length of the reverse thrust member with increasing distance from the hub.

Figure 7:
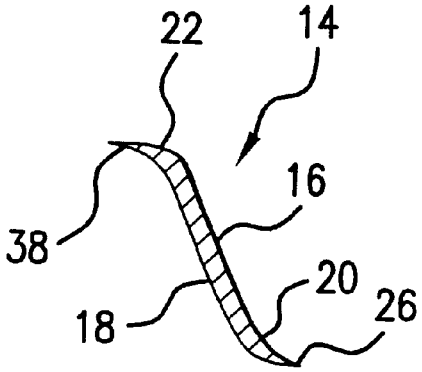
FIG. 7 is a cross-sectional view of an S-shaped blade of a third embodiment of the propeller of the invention providing a reverse thrust member on the leading edge and cupping on the trailing edge of the propeller blade.

FIG. 7 is a cross-sectional view of an S-shaped blade of a third embodiment of the propeller of the invention providing a reverse thrust member 26 on a leading edge 20 of a blade 14, and further providing a cupping 38 on the trailing edge 22 such that the cross-section of the blade 14, the cupping 38, and the reverse thrust member 26 together define an "S" shape. The pitch of the reverse thrust member is greater than that of the blade back 16, thus providing when reverse thrusting a watercraft the advantage of an increase in reverse travel per revolution of the propeller. The pitch of the cupping is greater than that of the blade face 18, thus providing when forward thrusting a watercraft the advantage of an increase in forward travel per revolution of the propeller.

Figure 8:
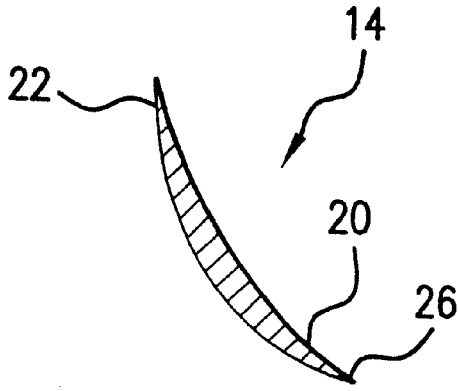
FIG. 8 is a cross-sectional view of a decreasing pitch blade of a fourth embodiment of the propeller of the invention.

FIG. 8 is a cross-sectional view of a decreasing or regressive pitch blade of a fourth embodiment of the propeller of the invention providing a reverse thrust member 26 extending along the blade 14 which provides a decreasing or regressive pitch from the leading edge 20 to the trailing edge 22. The regressive pitch blade thus provides adequate forward thrust in high payload circumstances while the reverse thrust member provides efficient performance in reverse thrusting.

Figure 9:
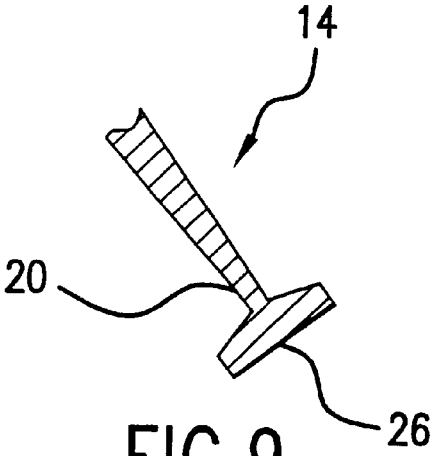
FIG. 9 is a cross-sectional view of the leading edge of the blade of a fifth embodiment of the propeller of the invention providing a T-shaped reverse thrust member.
Figure 10:
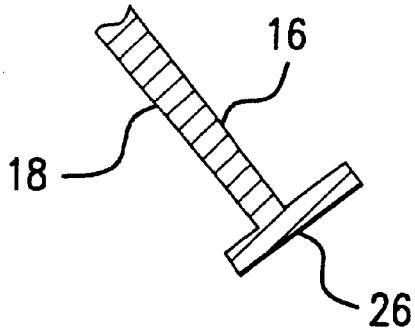
FIG. 10 is a cross-sectional view of the leading edge of the blade of an alternate embodiment of the propeller of FIG. 9 providing a T-shaped reverse thrust member.

FIG. 9 is a cross-sectional view of an alternate embodiment of the propeller blade having a leading edge 20 and a reverse thrust member 26 with a "T" shape in cross-section. FIG. 10 shows a cross-sectional view of yet another embodiment of the "T" shaped reverse thrust member 26, projecting further forward of the blade back 16 than rearward of the blade face 18.

Figure 11:
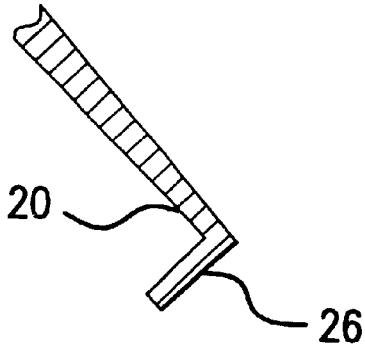
FIG. 11 is a cross-sectional view of the leading edge of the blade of a sixth embodiment of the propeller of the invention providing an L-shaped reverse thrust member.
Figure 12:
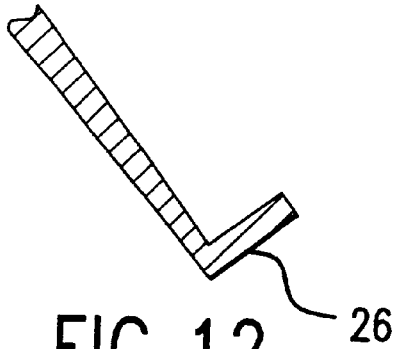
FIG. 12 is a cross-sectional view of the leading edge of the blade of an alternate embodiment of the propeller of FIG. 11.

FIG. 11 is a cross-sectional view of an embodiment of the propeller blade with a leading edge 20 and a reverse thrust member 26 having an "L" shape in cross-section. FIG. 12 shows a cross-sectional view of an alternate embodiment of the "L" shaped reverse thrust member 26.

The T-shaped and L-shaped embodiments of the reverse thrust members may extend entirely along the leading edge, or along any desired portion thereof, of the blade. In other embodiments, the T-shaped and L-shaped reverse thrust members may extend along both the leading and trailing edges of the blade, or along any desired portions thereof, including the blade tip, extending, for example, from hub to hub along the entire periphery of the blade.

All of the described embodiments of the invention may be used with any desired type of propeller driven watercraft. The propeller of the invention may be made of any suitable desired material, to include, but not limited to plastics, metals, bronze, aluminum, stainless steel, metal compounds, and composite materials. Additionally, the several embodiments of the invention may each comprise a boat propeller having a pitch of any value ranging from 2 inches through 40 inches, whether the pitch of the blade is variable, progressive, regressive, or constant. Further still, the several embodiments of the invention may each comprise a propeller with a rake of any desired rake value, whether a positive, a zero, or a negative rake.

The several embodiments of the invention may also comprise propellers of any desired size, for example, ranging in size from 6 inches through 200 inches in diameter, and of any style to include, but not limited to, cleaver, round ear, semi-cleaver, weedless, semi-weedless, elephant ear, clover leaf or circular blade propeller designs, and may be used with inboard, inboard-outboard, and/or outboard propulsion drive systems, as well as with through the hub exhaust propellers. The invention hereof may comprise propellers configured for use to be left-hand rotating, right-hand rotating, or as a duoprop, ie., two propellers are provided on a single drive shaft operating together in a left and a right hand rotational direction, respectively. The propellers so constructed may have two, three, four, five, six, seven, or eight blades, all as desired. The reverse thrust members of the invention may be attached to propellers of any thickness, contour, or variation of thickness, and propellers constructed to have or receive bezel rings or diffuser rings.

Any propeller incorporating the novel reverse thrust member of the invention, as disclosed hereinabove, may be manufactured by hand through any of the known methods of metal working, or by casting the propeller in a die, by sand or investment casting, with an aluminum mold, or through any currently known or yet to be developed methods of manufacturing boat propellers. Moreover, the inventive reverse thrust member can be formed integrally with or attached to the propeller, whether a one piece casting or assembled from a plurality of separate parts, to include propellers with detachable or replaceable blades. The inventive propeller may thus comprise any of the known types of hub centers, to include, but not limited to, brass centers, plastic centers, aluminum centers, stainless steel centers, metal centers, and composite material centers.

Although preferred embodiments of the invention have been disclosed in the foregoing specification, it is understood to those skilled in the art to which the invention pertains that many modifications and other embodiments of the invention will come to mind, having the benefit of the teaching presented in the foregoing description. Accordingly, it is understood that the invention is not limited to specific embodiments disclosed herein, and that many modifications and other embodiments of the invention are intended to be included in the scope hereof. Moreover, although specific terms are employed herein, they are used in the generic and descriptive sense only, and are not intended to limit the scope of the invention.

What is claimed is:

1. A propeller comprising:

a) a hub having an axis of rotation;

b) a plurality of blades connected to the hub and extending generally radially outwardly therefrom, each blade having a leading edge, a trailing edge, each blade defining a blade pitch between the leading edge and the trailing edge at a given radius from the axis of rotation;

c) at least one reverse thrust member connected to at least one blade of the propeller, said reverse thrust member having a proximal edge, a spaced distal edge, and projecting forward from at least a portion of the leading edge of the at least one blade, said proximal edge being connected to the at least a portion of the leading edge of the blade, wherein each reverse thrust member has a decreasing pitch from the distal edge toward the proximal edge of the reverse thrust member at the given radius.

2. The propeller of claim 1, wherein the blade pitch comprises an increasing pitch.

3. The propeller of claim 1, wherein the blade pitch is constant.

4. The propeller of claim 1, wherein the blade pitch comprises a decreasing pitch.

5. The propeller of claim 1, wherein said at least one reverse thrust member is formed as a part of the blade.

6. The propeller of claim 1, wherein said at least one reverse thrust member is arcuate in shape and defines a radius of curvature.

7. The propeller of claim 6, wherein the radius of curvature of the reverse thrust member is constant.

8. The propeller of claim 6, wherein the radius of curvature varies along at least a portion of increasing radii from the given radius.

9. The propeller of claim 1, wherein said at least one reverse thrust member defines a hook-shape in cross-section.

10. The propeller of claim 1, wherein at least a portion of said at least one reverse thrust member tapers from the proximal edge to the distal edge.

11. The propeller of claim 1, wherein the distal end of said at least one reverse thrust member defines a thickness, and wherein the thickness of the distal end of the reverse thrust member decreases along a portion of increasing radii from the given radius.

12. A propeller comprising:

a) a hub formed about a longitudinal axis;

b) a plurality of blades connected to the hub and extending generally radially outwardly therefrom, each blade having a leading edge, a trailing edge, the leading edge of each blade having a blade pitch at a given radius from said axis;

c) at least one reverse thrust member connected to a blade of the propeller, said at least one reverse thrust member having a proximal edge, a spaced distal edge, and projecting forward from at least a portion of the leading edge of the blade, said proximal edge being connected to the leading edge of the blade, wherein at least a portion of the distal edge of the reverse thrust member has a pitch greater than the blade pitch of the blade at the given radius.

13. The propeller of claim 12, wherein said at least one reverse thrust member is formed as a part of the blade.

14. The propeller of claim 12, wherein said at least one reverse thrust member comprises an arcuate shape and defines a radius of curvature.

15. The propeller of claim 14, wherein the radius of curvature varies along at least a portion of increasing radii from the given radius.

16. The propeller of claim 12, wherein the at least one reverse thrust member defines a hook-shape in cross-section.

17. The propeller of claim 12, wherein the at least one reverse thrust member defines an L-shape in cross-section.

18. The propeller of claim 12, wherein the at least one reverse thrust member defines a T-shape in cross-section.

19. The propeller of claim 12, further comprising a cupped portion connected to the trailing edge of the blade, wherein the cross sections of the cupped portion, the blade, and the at least one reverse thrust member together define an S-shape.

20. The propeller of claim 12, wherein at least a portion of the at least one reverse thrust member tapers from the proximal end to the distal end.

21. The propeller of claim 12, wherein the distal end of the reverse thrust member defines a thickness, and wherein the thickness of the distal end of the reverse thrust member decreases along a portion of increasing radii from the given radius.

22. A propeller comprising:

a) a hub formed about a longitudinal axis;

b) a plurality of blades connected to the hub and extending generally radially outwardly therefrom, each blade having a leading edge, a trailing edge, and a pressure surface defined between the leading edge and the trailing edge;

c) at least one reverse thrust member connected to at least one blade of the propeller and projecting forward from at least a portion of said leading edge, wherein at least a portion of the at least one reverse thrust member extends away from the pressure surface of the blade.

23. The propeller of claim 22, wherein at least a portion of the pressure surface has an increasing pitch from the leading edge to the trailing edge.

24. The propeller of claim 22, wherein said at least one reverse thrust member is formed as a part of the blade.

25. The propeller of claim 22, wherein said at least one reverse thrust member has a distal edge, wherein the leading edge of each blade has a blade pitch at a given radius said axis, and wherein at least a portion of the distal edge of the reverse thrust member has a pitch greater than the blade pitch at the given radius.

26. The propeller of claim 25, wherein at least a portion of said at least one reverse thrust member defines a hook-shape in cross-section.

27. The propeller of claim 25, wherein at least a portion of said at least one reverse thrust member defines an L-shape in cross-section.

28. The propeller of claim 25, wherein at least a portion of said at least one reverse thrust member defines a T-shape in cross-section.

29. The propeller of claim 25, wherein at least a portion of said at least one reverse thrust member is arcuate in shape.

* * * * *